United States Patent [19]

Graf

[11] 3,990,481

[45] Nov. 9, 1976

[54] LENO HEDDLES

[75] Inventor: Martin Graf, Horgenberg, Switzerland

[73] Assignee: Grob & Co. Aktiengesellschaft, Horgen, Switzerland

[22] Filed: June 10, 1975

[21] Appl. No.: 585,630

[30] Foreign Application Priority Data

June 10, 1974 Switzerland ..... 7898/74

[52] U.S. Cl. ..... 139/52

[51] Int. Cl.[2] ..... D03C 7/02

[58] Field of Search ..... 139/51–53, 139/93–96, 368

[56] References Cited

UNITED STATES PATENTS

| | | | |
|---|---|---|---|
| 648,573 | 5/1900 | Patterson | 139/52 |
| 1,050,734 | 1/1913 | Hamer | 139/52 |
| 1,413,949 | 4/1922 | Wagner | 139/96 X |
| 3,015,346 | 1/1962 | Kaufmann | 139/52 |
| 3,055,400 | 9/1962 | Frappe | 139/85 |
| 3,058,495 | 10/1962 | Kaufmann | 139/51 |

FOREIGN PATENTS OR APPLICATIONS

| | | | |
|---|---|---|---|
| 854,779 | 11/1952 | Germany | 139/93 |
| 723,298 | 2/1955 | United Kingdom | 139/93 |

*Primary Examiner*—James Kee Chi
*Attorney, Agent, or Firm*—Sughrue, Rothwell, Mion, Zinn & Macpeak

[57] ABSTRACT

A wear resistant leno heddle is disclosed which has a doup and two lifting heddles. The lifting heddles are formed in one piece by moulding a plastic material. The moulding technique allows the lifting heddles to be formed with varying cross-sectional dimensions according to the required strength of a given area. Reinforcing members may also be embedded within the lifting heddles to further increase its structural strength.

12 Claims, 6 Drawing Figures

1
2
3
4
5
6
7
8
9
10
11
12
13
14
15
16
17
18
19
20
21
22
23
24
25
26
27
28
29
IV
V

LENO HEDDLES

BACKGROUND OF THE INVENTION

1. Field of the Invention

The invention relates to a leno-heddle with two lifting heddles and one doup.

2. Prior Art

The lifting heddles known today consist of two shanks which are as a rule welded together. The two shanks of the lifting heddles suited for riderless heddle frames are welded together and on both the ends an end loop plate is welded on. The shanks of the lifting heddles are manufactured of a rolled flat steel strip and the doups are of a tempered strip steel.

Such leno-heddles are generally used up to now although some disadvantages are known which on fast running weaving machines become more and more apparent. During weaving, a dry friction between the lifting heddles and the doups will occur, which forms a metallic abrasive. This metallic abrasive can cause very unpleasant soiling on the fabric when weaving brightly dyed warp threads. Also, the wear and tear on the lifting heddles and the doups is too great resulting in poor operational characteristics and increased maintenance costs.

Since the shanks of the lifting heddles are made of rolled wire, the cross-section remains the same over their entire length. Therefore, it is not possible to increase the dimensions of parts which are exposed to greater stress and, on the other hand, to reduce parts which could be made lighter.

The lifting heddles suitable for riderless heddle frames consist of two shanks and two end loop plates which are welded onto same. Sometimes a plate is welded in between the shanks which can serve as resting point for the doup. The manufacture entails a lot of work and special steel alloys have to be used which can be processed only by means of expensive manufacturing methods.

SUMMARY OF THE INVENTION

The object of the invention is to produce, as far as possible, a wear resistant leno-heddle on which the lifting heddles can be shaped independently of a given material cross-section and which are more inexpensive in manufacturing than known lifting heddles. The principle object of the invention is a leno-heddle characterized in that the lifting heddles are formed from one piece and show over their length different material cross-sections adapted to the constructional requirements. Because the lifting heddles are formed from one piece, less dirt can accumulate, especially in the upper section, since fluff and dust cannot penetrate between the shanks of the lifting heddle. Instead of assembling the lifting heddles from different component parts, this can appropriately be cast moulded or injection moulded, whereas the selection of the material can be chosen from all mouldable or injectable materials. Therefore, a material can be selected which minimizes friction with the doup and the heddle carrying rods for the doup. The lifting heddles can be shaped as the need requires and as far as the chosen moulding or injection process allows it. There is also a possibility to mould-in reinforcements where such are necessary.

DETAILED DESCRIPTION OF THE PREFERRED EMBODIMENTS

Figures 1, 2, 3, 4, 5, 6:
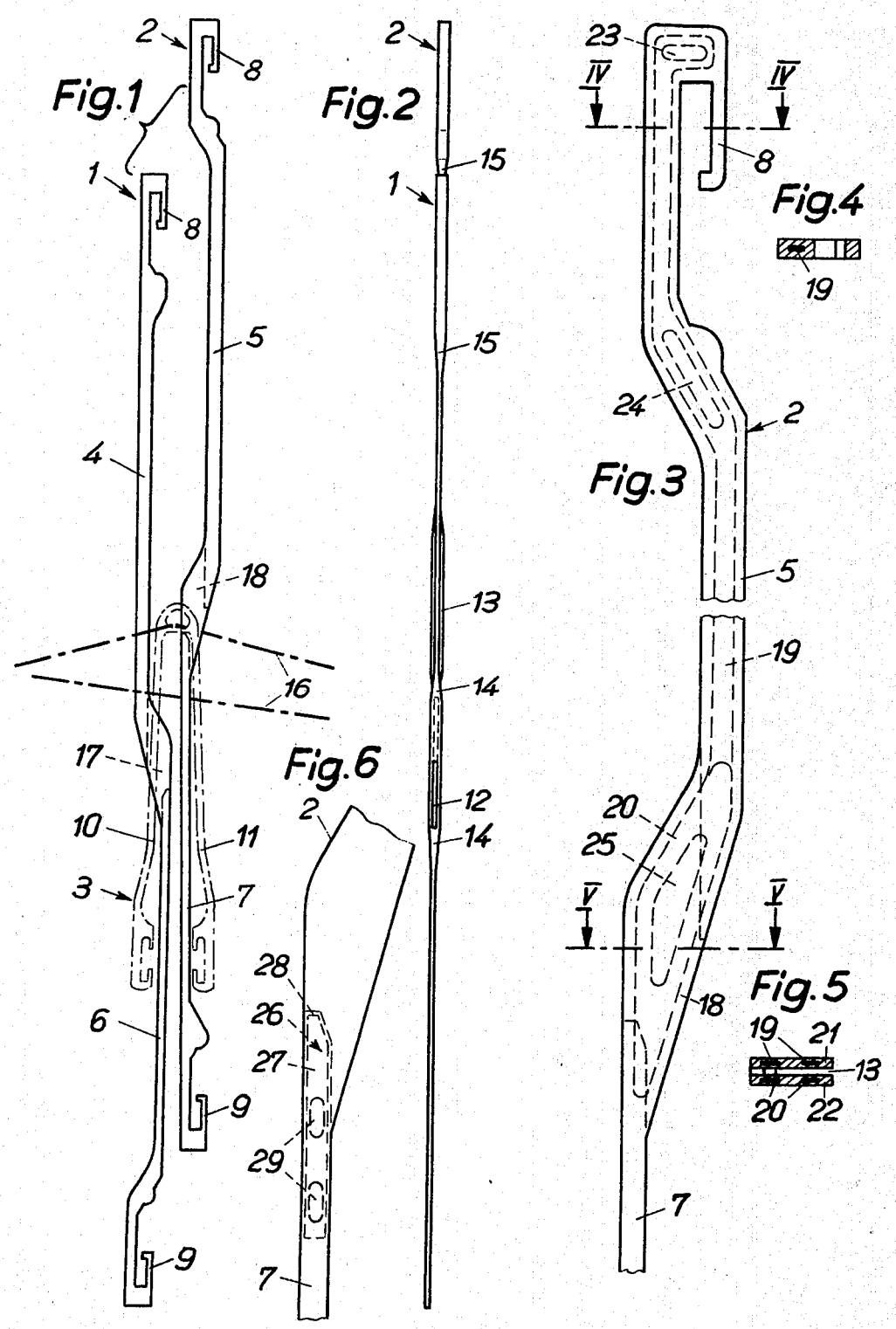
FIG. 1 shows a leno-heddle with one set of lifting heddles and a doup, according to the present invention.
FIG. 2 shows a front view of the lifting heddles of FIG. 1.
FIG. 3 shows an enlarged partial side view of one of the lifting heddles according to FIG. 1.
FIG. 4 shows a cross-section according to line IV—IV of FIG. 3.
FIG. 5 shows a cross-section according to line V—V of FIG. 3.
FIG. 6 shows an enlarged partial side view of a further embodiment of the lifting heddles according to FIG. 1.

In FIGS. 1 and 2, the lifting heddles are indicated by numbers 1 and 2. The doup 3 is indicated by dotted lines. Both the shanks 10, 11 of the doup 3 go through the openings 12, 13 of the lifting heddles 1, 2.

In the region of the openings 12, 13 the cross-section of the lifting heddles 1, 2 is reinforced by bulges 14 according to the occurring loads through the doup 3. This region is shaped considerably broader than the other sections of the lifting heddles 1, 2 which leads to a better and more accurate guiding of the doup 3 in the openings 12, 13. The wider gliding surfaces 17, 18 additionally reduce the specific pressure load and the abrasion caused through the up and down movement of the doup.

The end loops 8, 9 especially the upper end loops 8 which are exposed to greater stress can be more or less increased in mass 15 whereby the lining up density of the heddles has to be considered too. The upper shanks 4, 5 of the lifting heddles 1, 2 are exposed to greater stress than the lower shanks 6, 7 as the load occurring while lifting the doup 3, affects only the upper part. Therefore, the upper shanks 4, 5 are reinforced accordingly by means of increasing the cross-section. It is advantageous to reinforce the shanks 4, 5 by enlarging them in the direction of the warp thread 16, whereas the thickness should be kept as narrow as possible so that the warp thread 16 can glide easily and unhindered between the lifting heddles 1, 2, respectively.

The lower shanks 6, 7 serve only as a guide for the lifting heddles 1, 2 in the lower section and are thereby only exposed to minimum load. Therefore, these shanks 6, 7 can be kept very fine.

FIGS. 3 to 5 show how, for example, a lifting heddle cast moulded or injection moulded out of soft material, for instance plastic, can be reinforced with inserts 19, 20 from material with a higher strength. The insert 19, shown in the example, is made of punched tin sheet metal. The insert reaches from the upper end loop 8 to the region of the opening 13 and is in this region embedded in a rib. Another rib 22 is reinforced by means of insert 20 which covers only the region of the opening 13. The inserts 19, 20 are provided with perforations 23, 24, 25 in order to provide a better anchorage. The reinforcement could also be made out of inserted wires or fibres. On the lifting heddles 1, 2, respectively, the resting point 26 for the doup 3 has to take up the highest specific pressure load. FIG. 6 shows how this part can also be reinforced by means of a metallic insert 27. Therefore, at the resting point 26 there remains only a thin layer 28 of the softer material which gets supported by the insert 27. To achieve a better anchorage of the insert 27, the same is also provided with perforations 29. Such inserts could also be roughened or toothed so that they will be better kept in place by the basic material.

The changes of the cross-sections are exaggerated, for the purpose of clearer illustration.

What is claimed is:

1. A leno-heddle comprising two lifting heddles and one doup, each of said lifting heddles being comprised of an integrally moulded, one piece plastic structure having a varying thickness and width along the length thereof.

2. The leno-heddle of claim 1 wherein each of the lifting heddles has a guide opening therethrough for said doup in a portion of the heddle having increased thickness and width to provide increased strength and wider gliding surfaces for said doup.

3. The leno-heddle of claim 1 wherein each of the lifting heddles have upper end loops formed on the upper end and increased thickness adjacent said loops.

4. The leno-heddle of claim 1 wherein each of the lifting heddles has an upper and lower shank, the width of said upper shank being greater than the width of said lower shank.

5. The leno-heddle of claim 1 wherein each of the lifting heddles has at least one flat-plate-like reinforcing element embedded therein to increase the strength of said lifting heddles.

6. The leno-heddle of claim 5 wherein each of the lifting heddles has an upper end hoop and an opening therethrough for guiding the doup, wherein the reinforcing element extends in a longitudinal direction from the opening to the upper loop.

7. The leno-heddle of claim 5 wherein the reinforcing element is provided with perforations therethrough to increase the anchoring force within said lifting heddle.

8. The leno-heddle of claim 5 wherein each lifting heddle has an opening therethrough for guiding the doup and at least one rib protruding laterally from the lifting heddle adjacent said opening, wherein a reinforcing element is embedded in each rib.

9. The leno-heddle of claim 5 wherein the reinforcing element is a metallic sheet.

10. The leno-heddle of claim 5 wherein each lifting heddle has an opening therethrough for guiding the doup, the doup resting on a portion of the lifting heddle adjacent said opening, and the reinforcing element is provided in said portion.

11. The leno-heddle of claim 5 wherein the outer surface of the reinforcing element is roughened to increase its adhesion to the lifting heddle.

12. The leno-heddle of claim 1 wherein the lifting heddles and the doup are made from different material.

* * * * *